US006802710B2

(12) United States Patent
Hutmacher et al.

(10) Patent No.: US 6,802,710 B2
(45) Date of Patent: Oct. 12, 2004

(54) MULTIPLE HEARTH FURNACE

(75) Inventors: Patrick Hutmacher, Bettembourg (LU); Jeannot Konsbruck, Berbourg (LU); Edgar Kraemer, Hellange (LU); Emile Lonardi, Bascharage (LU)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 10/481,834

(22) PCT Filed: Jun. 18, 2002

(86) PCT No.: PCT/EP02/06683

§ 371 (c)(1),
(2), (4) Date: Dec. 23, 2003

(87) PCT Pub. No.: WO03/002925

PCT Pub. Date: Jan. 9, 2003

(65) Prior Publication Data

US 2004/0157182 A1 Aug. 12, 2004

(30) Foreign Application Priority Data

Jun. 26, 2001 (LU) ..... 90793

(51) Int. Cl.[7] ..... F27B 9/02
(52) U.S. Cl. ..... 432/131; 432/139
(58) Field of Search ..... 432/191, 192, 432/195, 131, 125, 139; 110/216

(56) References Cited

U.S. PATENT DOCUMENTS 2,511,281 A * 6/1950 Martin ..... 432/61
2,604,358 A 7/1952 Richards
3,131,919 A * 5/1964 Hartley et al. ..... 432/131
3,419,252 A * 12/1968 Dreusche Jr. ..... 432/131
3,874,644 A 4/1975 Grimes
3,905,757 A * 9/1975 von Dreushe, Jr. ..... 432/18
3,990,836 A * 11/1976 Bricmont ..... 432/75
4,503,627 A * 3/1985 Schumacher ..... 34/173
4,631,026 A 12/1986 McKinney
4,702,694 A 10/1987 Johnson et al.
5,316,471 A * 5/1994 Nell ..... 432/139

FOREIGN PATENT DOCUMENTS

DE 8624717 10/1986

* cited by examiner

*Primary Examiner*—Gregory Wilson
(74) *Attorney, Agent, or Firm*—McCormick, Paulding & Huber LLP

(57) ABSTRACT

A multiple hearth furnace includes an upright cylindrical furnace housing divided into a plurality of vertically aligned hearth chambers. A cleaning lance inlet port is sealingly connected to the cylindrical furnace housing and radially leads into one of the hearth chambers. A cleaning lance assembly is provided and includes an elongated mount arranged outside the furnace housing and the cleaning lance is slidably mounted on the elongated mount. The cleaning lance includes a cleaning nozzle and can be sealingly introduced through the lance inlet port along a radial trajectory into the hearth chamber by moving it along the elongated mount. The cleaning nozzle is arranged on the cleaning lance, so as to be capable of directing a jet of cleaning fluid onto a rabble arm that is positioned in a cleaning position in the vicinity of the radial trajectory when the cleaning lance is slidably moved along the elongate mount.

15 Claims, 4 Drawing Sheets

MULTIPLE HEARTH FURNACE

CROSS-REFERENCE TO RELATED APPLICATIONS

This application is entitled to the benefit of and incorporates by reference in their entireties essential subject matter disclosed in International Application No. PCT/EP02/06683 filed on Jun. 18, 2002 and Luxembourg Patent Application No. 90 793 filed on Jun. 26, 2001.

FIELD OF THE INVENTION

The present invention generally relates to a multiple hearth furnace.

BACKGROUND OF THE INVENTION

A multiple hearth furnace comprises an upright cylindrical furnace housing that is divided by a plurality of vertically spaced hearth floors in vertically aligned hearth chambers. A vertical shaft extends centrally through the hearth chambers, passing through each hearth floor. In each hearth chamber at least one rabble arm is fixed to the vertical shaft and extends radially outside therefrom over the hearth floor. Such a rabble arm is provided with rabble teeth, which extend down into material being processed on the hearth floor. As the vertical shaft rotates, the rabble arm moves over the material on the respective hearth floor, wherein the rabble teeth plough through the material and mix the latter. Depending on the angle of inclination of the rabble teeth, the material will be moved radially in towards the vertical shaft or outwardly therefrom. Drop holes are provided in each hearth floor, alternately in the inner zone of the hearth floor (i.e. near the vertical shaft) or in the outer zone of the hearth floor (i.e. near the cylindrical furnace housing). Material falling on the inner zone of a hearth floor is moved by the rabble arm radially outwards over this hearth floor, until it drops through a drop hole in the outer zone of this hearth floor on the outer zone of a hearth floor located directly below. On this lower hearth floor, material is moved by the rabble arm radially inwards until it drops through a drop hole in the inner zone of this hearth floor on the inner zone of the next lower hearth floor. Thus, material processed in the furnace is caused to move slowly along a serpentine path through the vertically aligned hearth chambers of the furnace.

It is a fact that multiple hearth furnaces possess major advantages over other solid material processing furnaces, such as rotary hearth furnaces, rotary kiln furnaces and shaft furnaces. By allowing a control of different hearth atmospheres and temperatures in the vertically aligned hearth chambers, they allow a very close control of the process inside the furnace. Other advantages of multiple hearth furnaces lie in their ability to maintain the processed materials in mixed condition throughout their passage through the furnace and to warrant a very intense exposure of the solid materials to process gases in a controlled gas/solid material counter flow within the furnace. Nevertheless, since their invention at the end of the nineteenth century, multiple hearth furnaces have only found very few applications in solid material processing. A reason for this lack of confidence in multiple hearth furnaces is that it has never been possible to warrant a problem-free operation of a multiple hearth furnace over longer periods.

One of the problems encountered with multiple hearth furnaces resides in the caking of material on the rabble arms, i.e. on the rabble teeth and their support structure. This caking of material on the rabble arms perturbs the operation of the hearth furnace, inter alia by bridge building between the rabble teeth, and is often a reason for severe damages to the rabble arms, the hearth floors, the vertical rotary shaft and the driving equipment of the latter.

OBJECTS AND SUMMARY OF THE INVENTION

A technical problem underlying the present invention is to provide a multiple hearth furnace in which excessive caking of material on the rabble arms can be efficiently avoided. This problem is solved by a rabble arm in accordance with the present invention.

A multiple hearth furnace in accordance with the present invention comprises—just as prior art furnaces: an upright cylindrical furnace housing; a plurality of vertically spaced hearth floors dividing the upright cylindrical furnace housing into a plurality of vertically aligned hearth chambers; a vertical rotary shaft extending centrally through the hearth chambers; and at least one rabble arm associated with each of the hearth floors. These rabble arms are fixed to the vertical rotary shaft and arranged and designed so as to urge, during their rotation, processed material over the associated hearth floor towards a drop hole therein, wherein the processed material falls through the drop hole onto a lower hearth floor. In accordance with an important aspect of the present invention, the multiple hearth further comprises at least one cleaning lance inlet port and a cleaning lance assembly, which is associated with this cleaning lance inlet port. The cleaning lance inlet port is sealingly connected to the cylindrical furnace housing and leads radially into one of the hearth chambers. The cleaning lance assembly includes an elongated mount that is arranged outside the furnace housing and at least one cleaning lance slidably mounted on the elongated mount. The cleaning lance is connected to a cleaning fluid distribution system and comprises at least one cleaning nozzle. It can be sealingly introduced through the at least one lance inlet port along a radial trajectory into the hearth chamber by moving it along the elongated mount. The cleaning nozzle is arranged on the cleaning lance, so as to be capable of directing a jet of cleaning fluid onto a rabble arm that is positioned in a cleaning position in the vicinity of the radial trajectory of the cleaning lance when the latter is slidably moved along the elongate mount. It will be appreciated that the rabble arms can be very easily cleaned in this multiple hearth furnace, which of course helps to avoid the aforementioned drawbacks of prior art multiple hearth furnaces due to the caking of material on the rabble arms, i.e. on the rabble teeth and their support structure. In particular, cleaning of the rabble arms does no longer necessitate a cooling down of the multiple hearth furnace.

In a preferred embodiment, the cleaning lance assembly includes: a first and a second cleaning lance. The first cleaning lance is slidably mounted on the mount so that it can be introduced through a first lance inlet port in the cylindrical furnace housing along a first radial trajectory into the hearth chamber. The second cleaning lance is slidably mounted on the mount so that it can be introduced through a second lance inlet port in the cylindrical furnace housing along a second radial trajectory into the same hearth chamber. Both cleaning lances are connected to a cleaning fluid distribution system, wherein each cleaning lance comprises at least one cleaning nozzle. The first radial trajectory is determined so that the at least one cleaning nozzle of the first cleaning lance is capable of directing its jet of cleaning fluid onto the top of a rabble arm that is positioned in the cleaning position. The second radial trajectory is determined so that the at least one cleaning nozzle of the second cleaning lance is capable of simultaneously directing its jet of cleaning fluid laterally onto the rabble teeth of the same rabble arm in the same cleaning position, when the first cleaning lance and the second cleaning lance are moved along the mount. It will be appreciated that this embodiment allows to efficiently remove baked layers of material from the lateral and top surfaces of the rabble arms and from the rabble teeth.

The first cleaning lance and the second cleaning lance are advantageously mounted on a common lance support carriage that is slidably supported on the mount and driven by an endless chain mounted in the mount. In order to make the cleaning of the rabble arms even more efficient, the cleaning lance may comprise at its front end a lateral array of cleaning nozzles.

In order to enable a cleaning of the vertical rotary shaft from baked layers of material, the cleaning lance may comprise at its front end at least one radial cleaning nozzle that is capable of directing a jet of cleaning fluid radially onto the vertical rotary shaft.

The cleaning lance may further comprise an internal cooling circuit, which protects it against heat radiation in the hearth chamber.

In accordance with a first embodiment, the cleaning lance assembly is permanently supported in front of the same lance inlet port.

In accordance with a second embodiment, the cleaning lance assembly is supported by a vertical lifting device, so that it can be lifted to different hearth chamber levels. At each of these hearth chamber levels, the cleaning lance can then be introduced through a corresponding lance inlet port into the respective hearth chamber.

In an advantageous embodiment, the cleaning lance assembly is pivotably supported by the vertical lifting device, so that it can be rotated about a substantially vertical axis between an operating position, in which the at least one lance is substantially parallel to a central axis of a lance inlet port, and a lifting position, in which the at least one cleaning lance is substantially perpendicular to the central axis of the lance inlet port. It will be appreciated that the lifting position of the cleaning lance assembly allows to lift the latter from one hearth chamber level to the other, without interfering e.g. with a structural steel framework surrounding the hearth furnace and without endangering operational staff on platforms around the hearth furnace.

In a preferred embodiment, the vertical lifting device includes a vertical rail assembly that is supported so as to be capable of rotating about its vertical axis. A lifting carriage is slidably supported in this vertical rail assembly, and the cleaning lance assembly is supported by this lifting carriage. First drive means are provided for moving the lifting carriage along the vertical rail assembly; and second drive means are provided for rotating the vertical rail assembly by an angle of 90° about its vertical axis.

In a preferred embodiment, the lance inlet port includes: a rigid inlet pipe connected to the cylindrical furnace housing and a ring-shaped lance sealing body connected to the rigid inlet pipe by means of a gastight flexible joint. The latter allows to compensate for misalignments of the cleaning lance and the lance inlet port.

The lance inlet port may further include a pivotable sealing flap, which seals it when the cleaning lance is withdrawn from the ring-shaped lance sealing body. This sealing flap further prevents material, which is urged by the rabble arms towards the outer wall of the furnace, from entering into the inlet port.

It remains to be said that the cleaning fluid is advantageously a gas-water mixture or mist, but that it is not excluded to chose a pressurised liquid, steam or gas as cleaning fluid.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
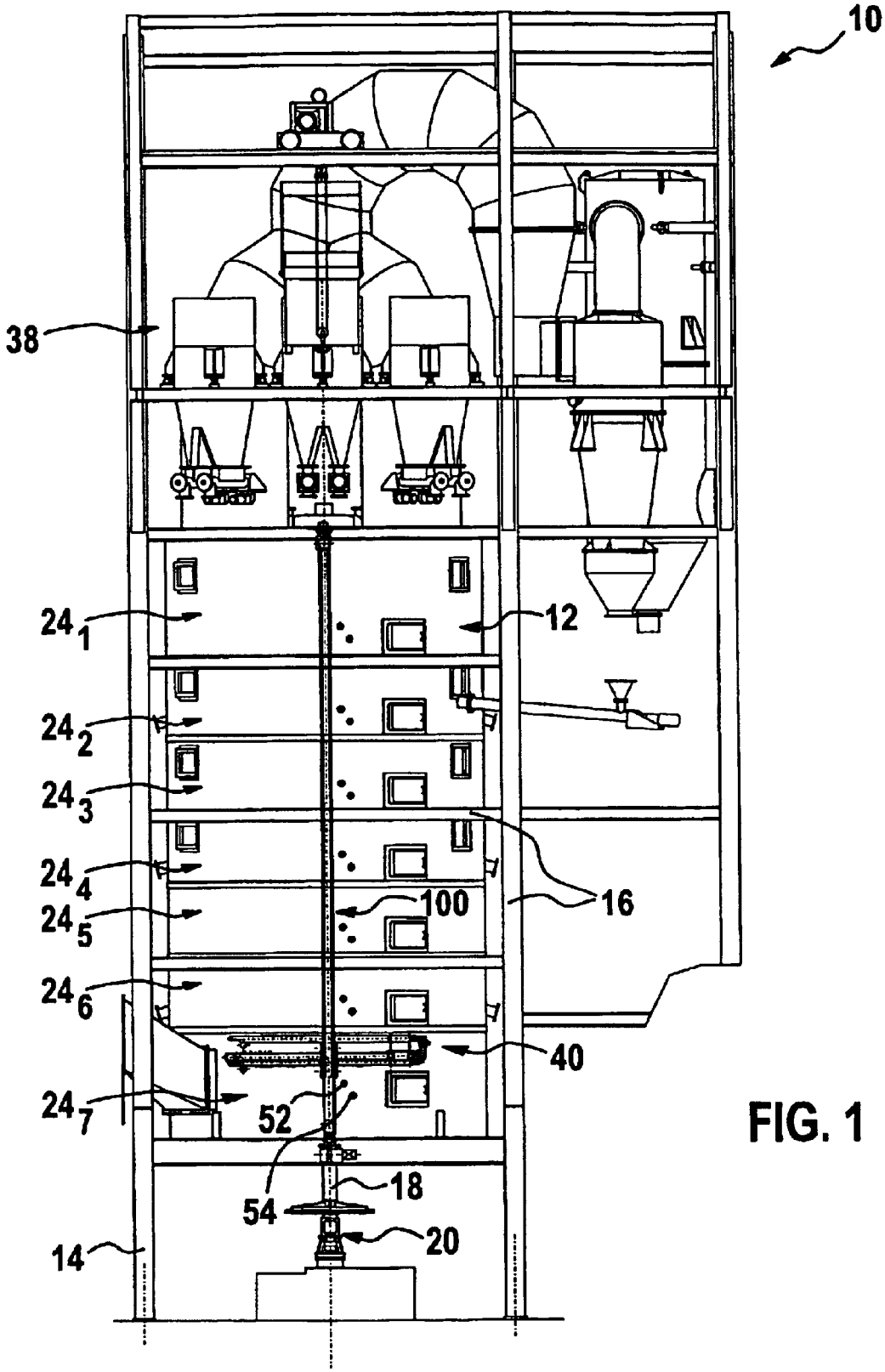
FIG. 1: is an elevation of a multiple hearth furnace including a cleaning lance assembly supported by a lifting device.

FIG. 1 shows an elevation of a multiple hearth furnace 10. The latter comprises an furnace housing 12 of a generally cylindrical configuration, which is mounted upright on a support structure 14 and surrounded by a framework of structural steel 16. A vertical rotary shaft 18 extends axially through the cylindrical housing 12 and is rotated by means of a motor 20. The interior of the cylindrical housing is divided by means of n intermediary hearth floors $\mathbf{22}_1$ (see FIG. 2) in n+1 hearth chambers $\mathbf{24}_1$ (n=6 in the multiple hearth furnace 10 of FIG. 1).

Figure 2:
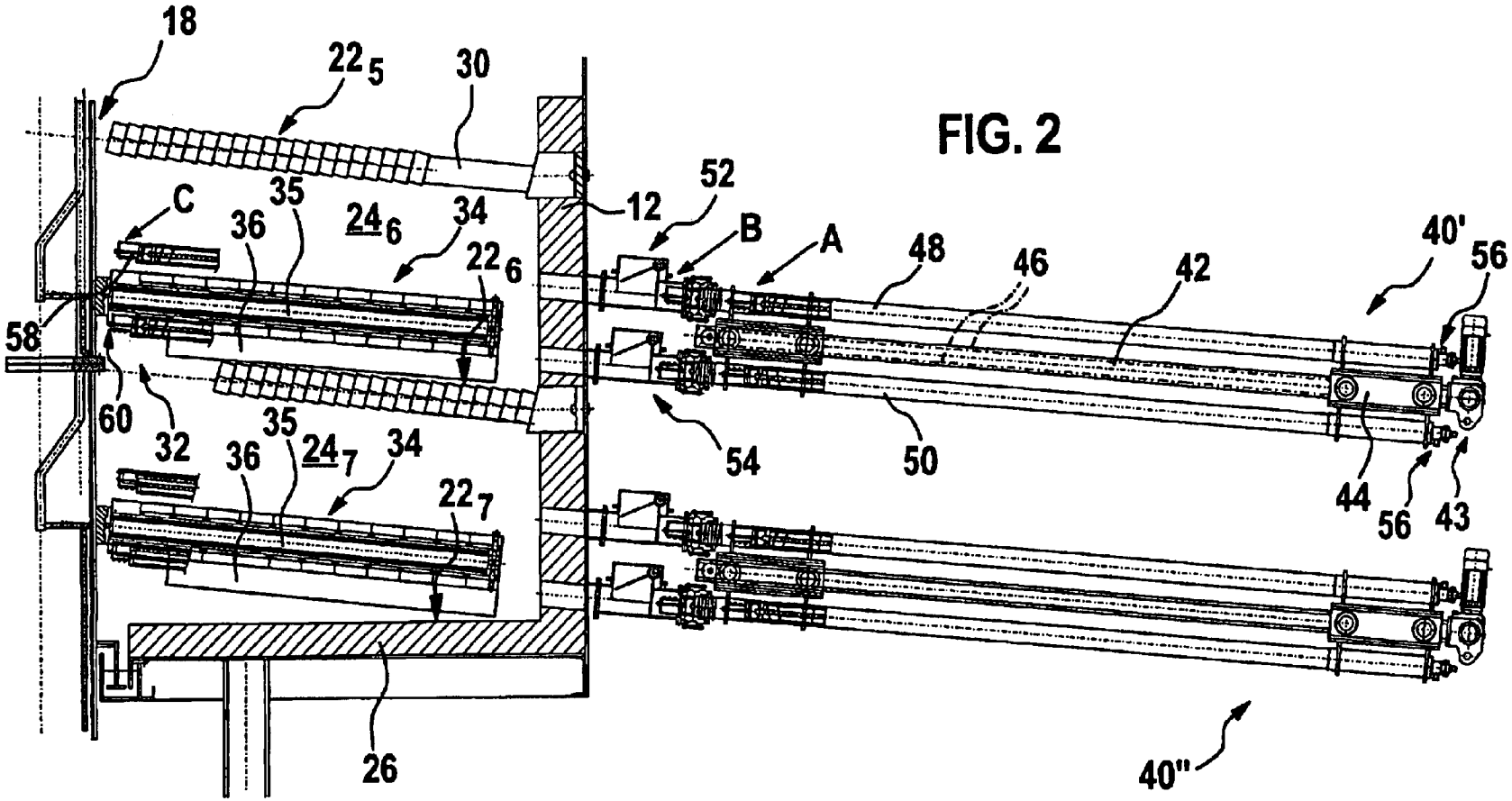
FIG. 2: is a partial vertical section through the two lowermost hearth chambers of a multiple hearth furnace as shown in FIG. 1, including a cleaning lance assembly that is permanently associated with a specific hearth chamber.

In FIG. 2, a section through the two lowermost hearth chambers $\mathbf{24}_6$ and $\mathbf{24}_7$ can be seen. It will be noted that an intermediary hearth floor $\mathbf{22}_6$ separates the sixth hearth chamber $\mathbf{24}_6$ from the seventh hearth chamber $\mathbf{24}_7$. Each of these intermediary hearth floors $\mathbf{22}_i$ (i=1 to 6) is made of refractory material in a pre-stressed configuration to be self-supporting within the furnace housing 12. The hearth floor $\mathbf{22}_7$ of the lowest hearth chamber $\mathbf{24}_7$ is formed by a refractory lining 26 on the furnace floor. Peripheral drop holes 30 are formed in the first, third and fifth intermediate hearth floors $\mathbf{22}_5$ around the outer shell 12. Central drop holes 32 are formed in the alternate hearth floors, i.e. the second, fourth and sixth hearth floor $\mathbf{22}_6$ around the vertical rotary shaft 18. A material outlet (not shown) is arranged in the hearth floor $\mathbf{22}_7$ of the lowest hearth chamber $\mathbf{24}_7$ at the outer periphery of the latter.

In each hearth chamber $\mathbf{24}_i$, a plurality of rabble arms 34 extend radially outwards from the vertical rotary shaft 18 over the respective hearth floor $\mathbf{22}_1$. The multiple hearth furnace 10 has for example four equally spaced rabble arms 34 in each hearth chamber $\mathbf{24}_i$. Each of these rabble arms 34 has an elongate support structure 35 and a plurality of rabble teeth 36, which extend downward to the respective hearth floor $\mathbf{22}_1$. As the vertical shaft 18 rotates, the rabble arms 34 move over the material on the respective hearth floor $\mathbf{22}_i$, wherein the rabble teeth 36 plough through the material on the hearth floor $\mathbf{22}_i$. In hearth chambers $\mathbf{24}_1$ having a hearth floor $\mathbf{22}_1$ with a central drop hole 32, such as e.g. in hearth chamber $\mathbf{24}_6$, the rabble teeth 36 are inclined with respect to the longitudinal axis of their respective rabble arm 34 so that the material on the hearth floor $\mathbf{22}_8$ will be moved from the periphery of the hearth floor $\mathbf{22}_6$ radially in towards the central drop hole 32 in the hearth floor $\mathbf{22}_5$. In hearth chambers $24_i$ having a hearth floor $22_i$ with peripheral drop holes 30, such as e.g. in hearth chamber $24_5$, the rabble teeth 36 are inclined with respect to the longitudinal axis of their respective rabble arm 34 so that the material will be moved radially out towards the peripheral drop holes 30 in the hearth floor $22_5$.

Operation of the multiple hearth furnace 10 as thus far described takes place in the following manner. Material to be processed is continuously supplied via a material feed equipment 38 into the first, i.e. upper-most hearth chamber $24_1$, where it falls upon the inner periphery of the first, i.e. the uppermost, furnace floor $22_1$. As the vertical shaft 18 rotates, the rabble arms 34 in the first hearth chamber $24_1$ gradually urge the material in a kind of spiral movement over the first hearth floor $22_1$ towards the peripheral drop hole in the latter. Through this peripheral drop hole material then drops down onto the second hearth floor $22_2$ in the second hearth chamber $24_2$, where associated rabble arms 34 gradually work the material towards the centre where it drops through the central drop holes down onto the third hearth floor $22_3$ in the third hearth chamber $24_3$. The material is then worked in the same way through the fourth, the fifth, the sixth and the seventh hearth chambers before it ultimately leaves the furnace 10 via the material outlet in the hearth floor $22_7$ of the lowest hearth chamber $24_7$. Process gases move in an ascending counter-flow through the multiple hearth furnace 10.

It will be noted that material falling through the drop holes 30, 32, in particular material falling through the inner drop holes 32, partially falls onto the rabble arms 34 moving over the hearth floor $22_1$ beneath. Part of this material bakes onto the cooled top surfaces of the rabble arms 34. Furthermore, material ploughed by rabble arms 34 also bakes onto the rabble teeth 36, onto the lateral surfaces of the rabble arms 34 and onto the vertical rotary shaft 18. It will be noted that material baking onto the lateral surfaces of the rabble arms 34 and onto the rabble teeth 36 favours bridge building between the rabble teeth 36. This bridge building will result in that the material transport and ploughing operation of the rabble arms 34 is disrupted. Material also bakes onto the outer wall of the vertical rotary shaft 18, which will result in a partial or complete obstruction of the inner drop holes 32. In summary, material layers building up on the rabble arms 34 and the vertical rotary shaft 18 generally perturb the operation of the hearth furnace and often result in severe damages to the rabble arms 34, the hearth floors $22_1$, the vertical rotary shaft 18 and the driving equipment 20 of the latter. It is therefore required to clean from time to time the rabble arms 34 and the rotary shaft 18 from excessive caking layers. In accordance with the present invention this is achieved with the help of at least one cleaning lance assembly 40.

FIG. 2 shows a cleaning lance assembly 40' for cleaning the rabble arms 34 of the hearth chamber $24_6$ and a cleaning lance assembly 40" for cleaning the rabble arms 34 of the hearth chamber $24_7$. Such a cleaning lance assembly 40', 40" comprises a mount 42, with a lance support carriage 44 advantageously supporting a pair of cleaning lances 48, 50. In the embodiment of FIG. 2 the mount is supported on a platform (not shown) that is rigidly supported by the framework of structural steel 16 (not shown in FIG. 2). The lance support carriage 44 is slidably guided in the mount 42 and driven along the mount 42 by an endless chain 46 connected to a rotary motor 43 at the rear end of the mount. With each lance 48, 50 is associated a lance inlet port 52, 54 in the cylindrical furnace housing 12. The lance support carriage 44 supports the cleaning lances 48, 50, so that each of them is capable of penetrating through its associated lance inlet port 52, 54 along a radial trajectory into the hearth chamber $24_1$, when the lance support carriage 44 is moved to the front end of the mount 42. In FIG. 2 the cleaning lances 48, 50 are shown with continuous lines in a retracted position (A) completely outside of the hearth chamber $24_1$. The tips of the cleaning lances 48, 50 of the lance assembly 40' are moreover shown with dotted lines in a position (B), in which they engage the lance inlet ports 48, 50, and in a position (C), in which they are located in direct vicinity of the vertical rotary shaft 18 of the multiple hearth furnace 10.

The cleaning lances 48, 50 are connected to a cleaning fluid distribution system, schematically identified by arrows 56. The cleaning fluid supplied by this cleaning fluid distribution system 56 is advantageously a pressurised liquid/gas mixture or mist. Alternatively, the cleaning fluid may be pressurised liquid, pressurised steam or pressurised gas.

Figure 6:
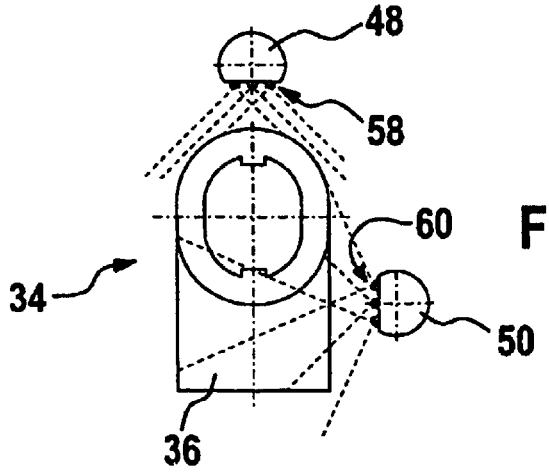
FIG. 6: is a cross section through a rabble arm showing cleaning nozzles of a cleaning lance assembly directing jets of cleaning fluid onto the rabble arm.

While the two lances 48, 50 of a lance assembly 40', 40" are radially introduced into the hearth chamber $24_i$, an array of cleaning nozzles 58, 60, which is located at the front end of each lance 48, 50, directs a jet of cleaning fluid onto a rabble arm 34, which has beforehand been positioned in a cleaning position in the vicinity of the radial trajectory of the cleaning lances 48, 50. As shown in FIG. 6, the cleaning nozzles 58 of the upper lance 48 direct jets of cleaning fluid mainly onto the top surfaces of the rabble arm 34, whereas the cleaning nozzles 60 of the lateral lance 50 direct jets of cleaning fluid mainly onto the rabble teeth 36 and the lateral surfaces of the rabble arm 34. Once one rabble arm 34 has been cleaned, the cleaning lances 48, 50 are withdrawn from the hearth chamber 24 and the next rabble arm 34 is positioned in the so called cleaning position.

Figure 5:
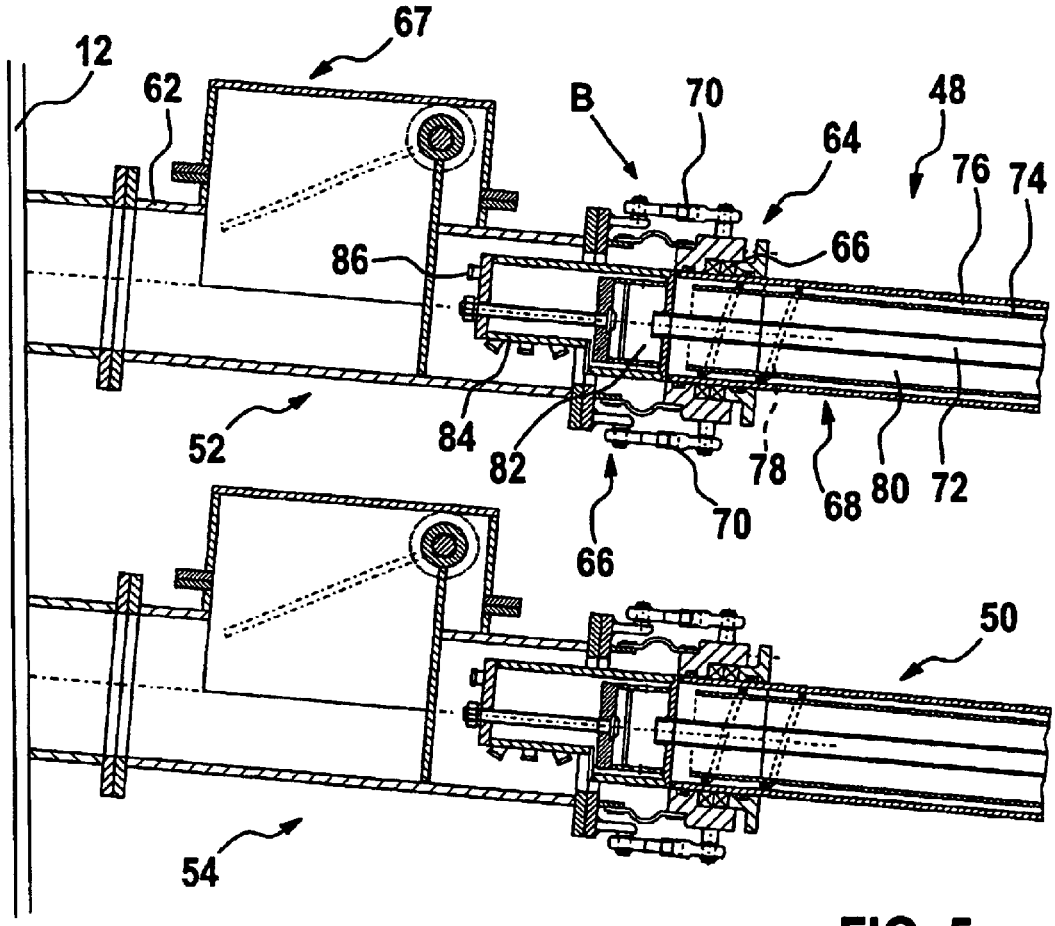
FIG. 5: is an enlarged detail of FIG. 2.

FIG. 5 is an enlarged detail of FIG. 2 showing the tips of the cleaning lances 48, 50 of the lance assembly 40' in the position B, in which they engage the lance inlet ports 52, 54. Each of these inlet ports 52, 54 comprises a rigid inlet pipe 62 and a ring-shaped lance sealing body 64. The rigid inlet pipe 62 is rigidly connected to the cylindrical furnace housing 12. The ring-shaped lance sealing body 64 is connected to the rigid inlet pipe 62 by means of a gastight flexible joint 66, which enables it to change its angular position relative to the rigid inlet pipe 62. A sealing flap 67 is integrated in the inlet pipe 62, so as to be pushed open by the tip of the cleaning lance 48, 50, when the latter is introduced into the hearth chamber $24_i$, and to be urged back (e.g. by gravity or by a spring) into its closed position, when the tip of the cleaning lance 48, 50 is withdrawn from the hearth chamber $24_1$, into the position B shown on FIG. 5.

The ring-shaped lance sealing body 64 includes a set of sealing elements 66, which engage a cylindrical lance housing 68. As the sealed section in the ring-shaped lance sealing body 64 is much smaller than the free section in the rigid inlet pipe 62, the flexibly supported ring-shaped lance sealing body 64 can compensate for alignment errors of the cleaning lances 48, 50 and for relative movement of the cleaning lances 48, 50 and the rigid inlet pipes 62. Such relative movement is e.g. due to thermal expansion/retraction of the furnace housing 12. It will be noted that the gastight flexible joint 66 includes articulated bridging rods 70, which limit its deformations.

FIG. 5 also shows the internal structure of the cleaning lances 48, 50 in greater detail. Reference number 72 identifies a cleaning fluid supply tube, which is axially housed in the cylindrical lance housing 68. The latter further comprises an inner jacket 74, which is arranged in the cylindrical lance housing 68 so as to delimit therein an annular gap 76 for a coolant flow around the inner wall of the lance housing 68. A wire 78 (only shown in part) is arranged in this annular gap 76 so as to define a spiral flow path for the coolant therein. Through an inlet opening at the rear end of the cleaning lance 48, 50 (not shown in FIG. 5), the coolant enters into the annular gap 76, wherein it is channelled in a spiral path along the inner wall of the cylindrical lance housing 68 to the tip of the cleaning lance 48, 50. Here the coolant passes into an inner return channel 80, wherein it is channelled back to the rear end of the cleaning lance 48, 50 around the cleaning fluid supply tube 72. It remains to be noted that in most cases the coolant will be water, but in specific cases it could be of interest to use a different cooling fluid than water.

The cleaning fluid supply tube 72 supplies the cleaning fluid into a cleaning fluid distribution chamber 82, which is in fluid communication with an exchangeable cleaning head 84. The latter includes the aforementioned arrays of cleaning nozzles 58, 60. Reference number 86 identifies a radial cleaning nozzle that is located at the front end of the cleaning head 84, so as to be capable of directing a jet of cleaning fluid radially onto the vertical rotary shaft 18.

In the embodiment of FIG. 2, a cleaning lance assemblies 40', 40" is permanently supported in front of the lance inlet ports 52, 54. In Accordance with this concept, the hearth furnace 10 requires one cleaning lance assembly 40', 40" per hearth chamber $\mathbf{24}_1$. With the embodiment of FIG. 1, however, the hearth furnace 10 requires only one cleaning lance assembly 40 for servicing the seven hearth chambers $\mathbf{24}_1$ of the hearth furnace 10. This is achieved by supporting the cleaning lance assembly 40 with a vertical lifting device 100, so that it can be lifted to different hearth chamber levels, wherein the two cleaning lances 48, 50 can be introduced through corresponding lance inlet ports 52, 54 into the respective hearth chamber $\mathbf{24}_1$.

Figure 4:
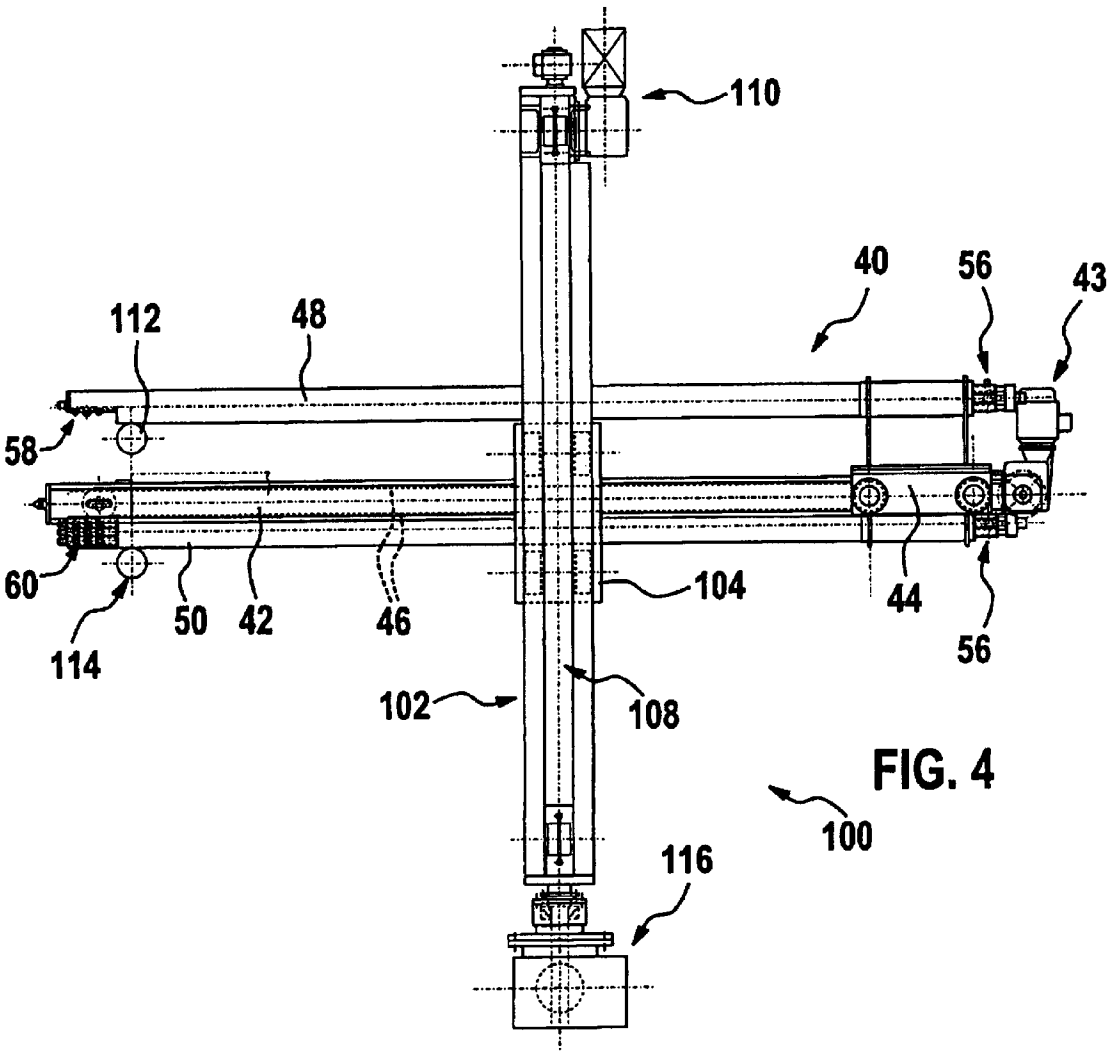
FIG. 4: is a side view of the cleaning lance assembly of FIG. 3.
Figure 3:
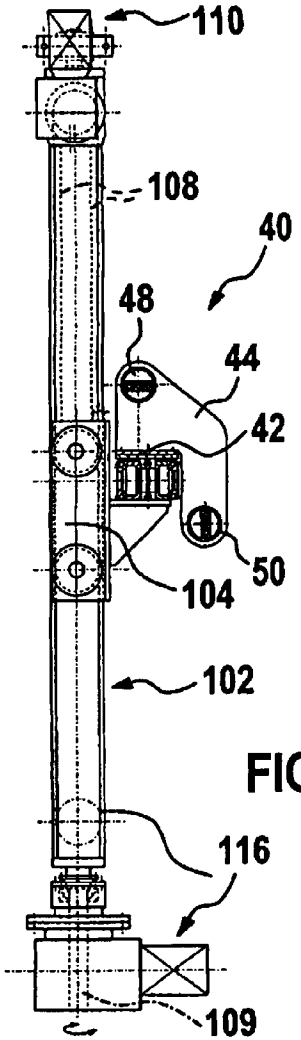
FIG. 3: is an elevation of a cleaning lance assembly with lifting device.

The cleaning lance assembly 40 with the lifting device 100 will now be described in greater detail with reference to FIGS. 3 & 4. The lifting assembly 100 includes a vertical rail assembly 102. A lifting carriage 104 is slidably supported in the vertical rail assembly 102, and a first drive means, including e.g. an endless chain 108 driven by a motor 110, allows to move this lifting carriage 104 along the vertical rail assembly 102. The mount 42 of the cleaning lance assembly 40 is supported by the lifting carriage 104. It comprises a front roller 112, 114, for supporting each of the cleaning lances 48, 50 at the front end of the mount 42, when the cleaning lance 48, 50 is not supported in the ring-shaped lance sealing body 64 of a lance inlet port 53, 54.

It will be noted that the vertical rail assembly 102 is advantageously supported so as to be capable of being rotated about its vertical axis 109 by means of second drive means, comprising e.g. a rotary motor 116. This feature allows to rotate the cleaning lance assembly 40 about a substantially vertical axis between an operating position, in which the cleaning lances are substantially parallel to the central axis of their lance inlet port, and a lifting position, in which they are substantially perpendicular to the central axis of their lance inlet port. This lifting position is illustrated in FIG. 1. It will be appreciated that the lifting position allows to lift the cleaning lance assembly 40 from one hearth chamber level to the other, without interfering e.g. with the structural steel framework 16 surrounding the hearth furnace 10 and without endangering operational staff on the platforms around the hearth furnace 10.

An accurate height positioning of the cleaning lance assembly 40 relative to lance inlet ports 52, 54 can e.g. be achieved with the help of a LASER positioning system, wherein a LASER source (not shown) is mounted on the cleaning lance assembly 40 and at least one LASER-beam detecting field is associated with the furnace housing 12, which is subjected to thermal expansion and retractions.

The positioning of each rabble arm 34 in its cleaning position is advantageously achieved by means of a rotational encoder associated with the vertical rotary shaft 18.

What is claimed is:

1. A multiple hearth furnace comprising:

an upright cylindrical furnace housing;

a plurality of vertically spaced hearth floors dividing said upright cylindrical furnace housing into a plurality of vertically aligned hearth chambers;

a vertical rotary shaft extending centrally through said hearth chambers;

at least one rabble arm associated with each of said hearth floors, said rabble arm being fixed to said vertical rotary shaft and being arranged and designed so as to urge, during its rotation, processed material over the associated hearth floor towards a drop hole therein, said processed material falling through said drop hole onto a lower hearth floor;

at least one cleaning lance inlet port sealingly connected to said cylindrical furnace housing and radially leading into one of said hearth chambers; and a cleaning lance assembly including:

an elongated mount that is arranged outside said furnace housing; and at least one cleaning lance slidably mounted on said elongated mount, said at least one cleaning lance being connected to a cleaning fluid distribution system and comprising at least one cleaning nozzle; wherein:

said at least one cleaning lance can be sealingly introduced through said at least one lance inlet port along a radial trajectory into said hearth chamber by moving it along said elongated mount; and said at least one cleaning nozzle is arranged on said cleaning lance, so as to be capable of directing a jet of cleaning fluid onto a rabble arm that is positioned in a cleaning position in the vicinity of said radial trajectory when said cleaning lance is slidably moved along said elongate mount.

2. The multiple hearth furnace as claimed in claim 1, wherein said cleaning lance assembly includes:

a first cleaning lance slidably mounted on said mount so that it can be introduced through a first lance inlet port in said cylindrical furnace housing along a first radial trajectory into said hearth chamber;

a second cleaning lance slidably mounted on said mount so that it can be introduced through a second lance inlet port in said cylindrical furnace housing along a second radial trajectory into the same hearth chamber;

said first cleaning lance and said second cleaning lance being connected to a cleaning fluid distribution system and each comprising at least one cleaning nozzle;

wherein said first radial trajectory is determined so that said at least one cleaning nozzle of said first cleaning lance is capable of directing its jet of cleaning fluid onto the top of a rabble arm that is positioned in said cleaning position, and said second radial trajectory is determined so that said at least one cleaning nozzle of said second cleaning lance is capable of simultaneously directing its jet of cleaning fluid laterally onto rabble teeth of the same rabble arm in the same cleaning position, when said first cleaning lance and said second cleaning lance are moved along said mount.

3. The multiple hearth furnace as claimed in claim 2, wherein said first cleaning lance and said second cleaning lance are mounted on a common lance support carriage that is slidably supported on said mount and driven by an endless chain mounted in said mount.

4. The multiple hearth furnace as claimed in claim 1, wherein said cleaning lance comprises at its front end a lateral array of cleaning nozzles.

5. The multiple hearth furnace as claimed in claim 4, wherein said cleaning lance comprises at its front end at least one radial cleaning nozzle that is capable of directing a jet of cleaning fluid radially onto said vertical rotary shaft.

6. The multiple hearth furnace as claimed in claim 1, wherein said cleaning lance comprises an internal cooling circuit.

7. The multiple hearth furnace as claimed in claim 1, wherein said cleaning lance assembly is permanently supported in front of the same lance inlet port.

8. The multiple hearth furnace as claimed in claim 1, further comprising a vertical lifting device supporting said cleaning lance assembly, so that the latter can be lifted to different hearth chamber levels, wherein said at least one cleaning lance can be introduced through a lance inlet port into the respective hearth chamber at each of said hearth chamber levels.

9. The multiple hearth furnace as claimed in claim 8, wherein said mount has a front end and a rear end and comprises a support roller for said at least one cleaning lance on its front end.

10. The multiple hearth furnace as claimed in claim 8, wherein said cleaning lance assembly is pivotably supported by said vertical lifting device, so that it can be rotated about a substantially vertical axis between an operating position, in which said at least one cleaning lance is substantially parallel to a central axis of a lance inlet port, and a lifting position, in which said at least one cleaning lance is substantially perpendicular to said central axis of said lance inlet port.

11. The multiple hearth furnace as claimed in claim 10, wherein said vertical lifting device includes:

a vertical rail assembly that is supported so as to be capable of rotating about its vertical axis;

a lifting carriage slidably supported in said vertical rail assembly, said cleaning lance assembly being supported by said lifting carriage;

first drive means for moving said lifting carriage along said vertical rail assembly; and second drive means for rotating said vertical rail assembly by an angle of 90° about its vertical axis.

12. The multiple hearth furnace as claimed in claim 1, wherein said lance inlet port includes:

a rigid inlet pipe connected to said cylindrical furnace housing;

a ring-shaped lance sealing body connected to said rigid inlet pipe by means of a gastight flexible joint.

13. The multiple hearth furnace as claimed in claim 12, wherein said lance inlet port includes a pivotable sealing flap.

14. The multiple hearth furnace as claimed in claim 1, wherein said lance inlet port includes a pivotable sealing flap.

15. The multiple hearth furnace as claimed in claim 1, wherein said cleaning fluid is a gas-water mixture or mist.

* * * * *